US006606869B2

(12) United States Patent
Takahashi et al.

(10) Patent No.: US 6,606,869 B2
(45) Date of Patent: Aug. 19, 2003

(54) REFRIGERATOR

(75) Inventors: Yasuyuki Takahashi, Gunma (JP); Kiyotaka Nagao, Gunma (JP); Toshihide Hasegawa, Gunma (JP); Masahiko Asami, Gunma (JP); Motoharu Kobayashi, Gunma (JP); Masashi Toyoshima, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/064,557

(22) Filed: Jul. 26, 2002

(65) Prior Publication Data

US 2003/0019222 A1 Jan. 30, 2003

(30) Foreign Application Priority Data

Jul. 27, 2001 (JP) ..... 2001-227375
Aug. 2, 2001 (JP) ..... 2001-235300

(51) Int. Cl.[7] ..... F25B 49/00; F24F 3/16

(52) U.S. Cl. ..... 62/131; 62/78; 62/314; 62/264

(58) Field of Search ..... 62/264, 131, 78, 62/314

(56) References Cited

U.S. PATENT DOCUMENTS 4,108,363 A * 8/1978 Susumu ..... 235/383
4,954,465 A * 9/1990 Kawashima et al. ..... 502/5
4,955,208 A * 9/1990 Kawashima et al. ..... 62/264
5,836,669 A * 11/1998 Hed ..... 362/92
6,286,330 B1 * 9/2001 Kopf ..... 62/314
6,328,937 B1 * 12/2001 Glazman ..... 422/186.3

* cited by examiner

*Primary Examiner*—William C. Doerrler
*Assistant Examiner*—Mark Shulman
(74) *Attorney, Agent, or Firm*—Jianq Chyun IP Office

(57) ABSTRACT

A refrigerator is provided. The refrigerator comprises an ultraviolet discharging lamp, for irradiating ultraviolet rays to an air duct inside the refrigerator, and irradiating a visible light to a cold storage compartment of the refrigerator; a light catalyst filter, installed in the air duct and activated by the ultraviolet rays; a fan for forming an air curtain when a door of the cold storage compartment of the refrigerator is opened; and a controlling device for lighting the ultraviolet discharging lamp when the door of the cold storage compartment of the refrigerator is opened. In addition, the refrigerator can further comprise an operating device for setting or disabling an antimicrobial mode of the refrigerator; and a controlling device for lighting the ultraviolet discharging lamp for a preset interval, and turning off the ultraviolet discharging lamp when a door of the refrigerator is opened, when the antimicrobial mode is disabled.

16 Claims, 5 Drawing Sheets

REFRIGERATOR

CROSS REFERENCE TO RELATED APPLICATIONS

This application claims the priority benefit of Japanese application serial no.2001-227375 filed on Jul. 27, 2001 and 2001-235300 filed on Aug. 2, 2001.

BACKGROUND OF INVENTION

FIELD OF THE INVENTION

This invention relates in general to a refrigerator having an antimicrobial function and a deodorization function by using an ultraviolet lamp and a light deodorization filter.

SUMMARY OF INVENTION

According to the foregoing description, an object of this invention is to provide a refrigerator capable of performing an antimicrobial function and a deodorization function by using an ultraviolet lamp and a light deodorization filter.

Another object of this invention is to provide a method suitable for controlling the above refrigerator.

According to the object(s) mentioned above, the invention provides a refrigerator, comprising an ultraviolet discharging lamp, for irradiating ultraviolet rays to an air duct inside the refrigerator, and irradiating a visible light to a cold storage compartment of the refrigerator; a light catalyst filter, installed in the air duct and activated by the ultraviolet rays; and a controlling device for lighting the ultraviolet discharging lamp when a door of the cold storage compartment of the refrigerator is opened. The refrigerator can further comprise a fan for creating an air curtain.

The controlling device lights the ultraviolet discharging lamp after a preset (for example, 5 minutes) from a time that the door is closed. The controlling device stops the fan forming the air curtain when the door is continuously opened for a second preset time interval (for example, 1 minute). The controlling device turns off the ultraviolet discharging lamp when the door is continuously opened for a third preset time interval (for example, 1 minute).

In addition, the controlling device lights the ultraviolet discharging lamp when the door is closed for over a fourth preset time (for example, 4 hours). In addition, when the door is closed for over a fourth preset time and a cooler of the refrigerator does not defrost, the controlling device can light the ultraviolet discharging lamp.

The invention further provides a refrigerator, comprising: an ultraviolet discharging lamp, for irradiating ultraviolet rays to an air duct inside the refrigerator, and irradiating a visible light to a cold storage compartment of the refrigerator; a light catalyst filter, installed in the air duct and activated by the ultraviolet rays; an operating device for setting or disabling an antimicrobial mode of the refrigerator; and a controlling device for lighting the ultraviolet discharging lamp for a preset interval (for example, 4 hours) and turning off the ultraviolet discharging lamp when a door of the refrigerator is opened, when the antimicrobial mode is disabled.

Each of the above refrigerators can further comprise a lighting display device, arranged outside of the refrigerator, for displaying a status whether the ultraviolet discharging lamp is lit or not.

The invention further provides a refrigerator, comprising an ultraviolet lamp, for irradiating ultraviolet rays to an air duct inside the refrigerator, and irradiating a visible light to a cold storage compartment of the refrigerator; a light catalyst filter, installed in the air duct and activated by the ultraviolet rays; an operating device for setting or disabling an antimicrobial mode of the refrigerator; and a controlling device for keeping the ultraviolet discharging lamp lit, even when the antimicrobial mode is disabled and in an interval other than when a cooler of the refrigerator defrosts.

The invention further provides a refrigerator, comprising: an ultraviolet discharging lamp, for irradiating ultraviolet rays to an air duct inside the refrigerator, and irradiating a visible light to a cold storage compartment of the refrigerator; a light catalyst filter, installed in the air duct and activated by the ultraviolet rays; and a controlling device for lighting the ultraviolet discharging lamp, when a door of the refrigerator is opened, wherein the controlling device lights the ultraviolet discharging lamp after a preset interval from a time that the door is closed.

The invention further provides a refrigerator, comprising an ultraviolet lamp, for irradiating ultraviolet rays to an air duct inside the refrigerator, and irradiating a visible light to a cold storage compartment of the refrigerator; a light catalyst filter, installed in the air duct and activated by the ultraviolet rays; and a lighting display device, arranged outside of the refrigerator, for displaying a status whether the ultraviolet discharging lamp is lit or not.

The invention further provides a refrigerator, comprising an ultraviolet lamp, for irradiating ultraviolet rays; a light catalyst filter, installed in the air duct and activated by the ultraviolet rays; an operating device for setting or disabling an antimicrobial mode of the refrigerator; and a controlling device for keeping the ultraviolet discharging lamp lit, even when an antimicrobial mode of the refrigerator is disabled.

BRIEF DESCRIPTION OF DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DETAILED DESCRIPTION

The preferred embodiment of the invention is described in detail with reference to the drawings.

Figure 1:
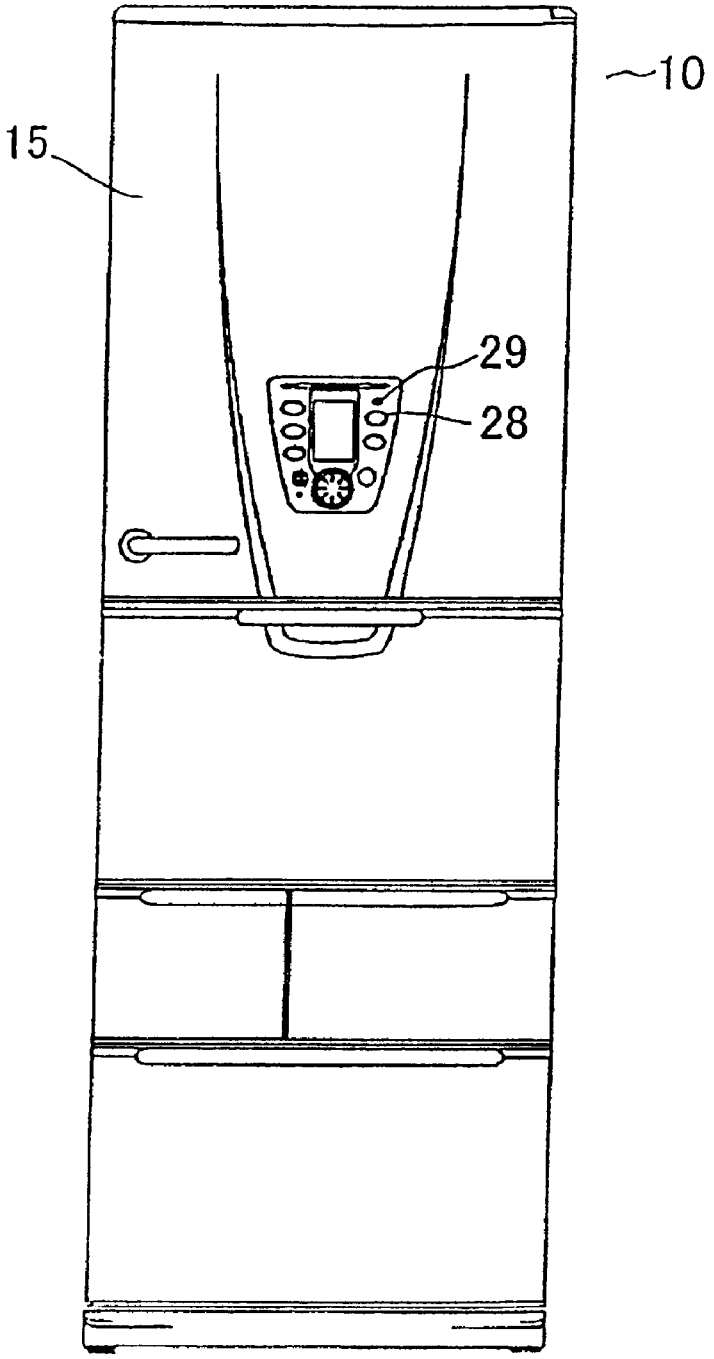
FIG. 1 shows a front view of a refrigerator according to the embodiment of the invention.
Figure 2:
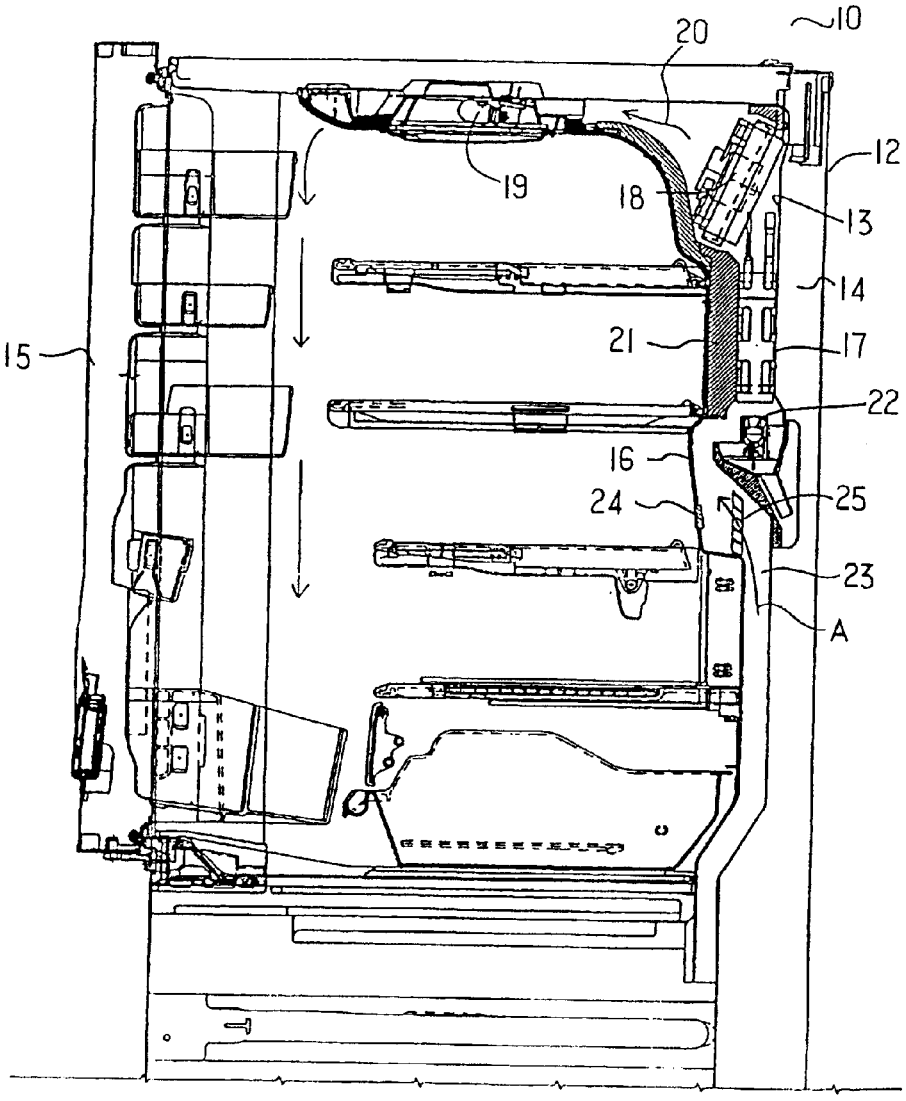
FIG. 2 shows a portion of the cross-sectional view of the refrigerator
Figure 3:
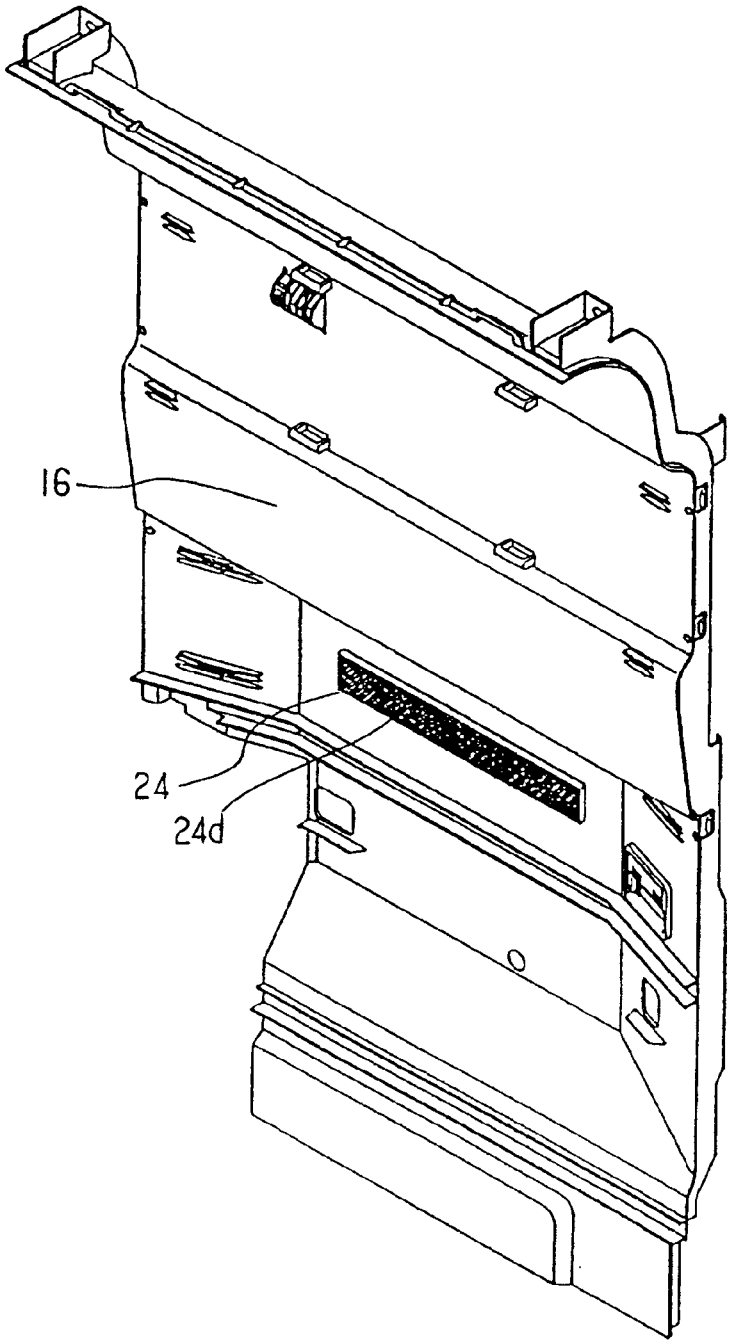
FIG. 3 shows a back panel of the internal room of the refrigerator.
Figure 4:
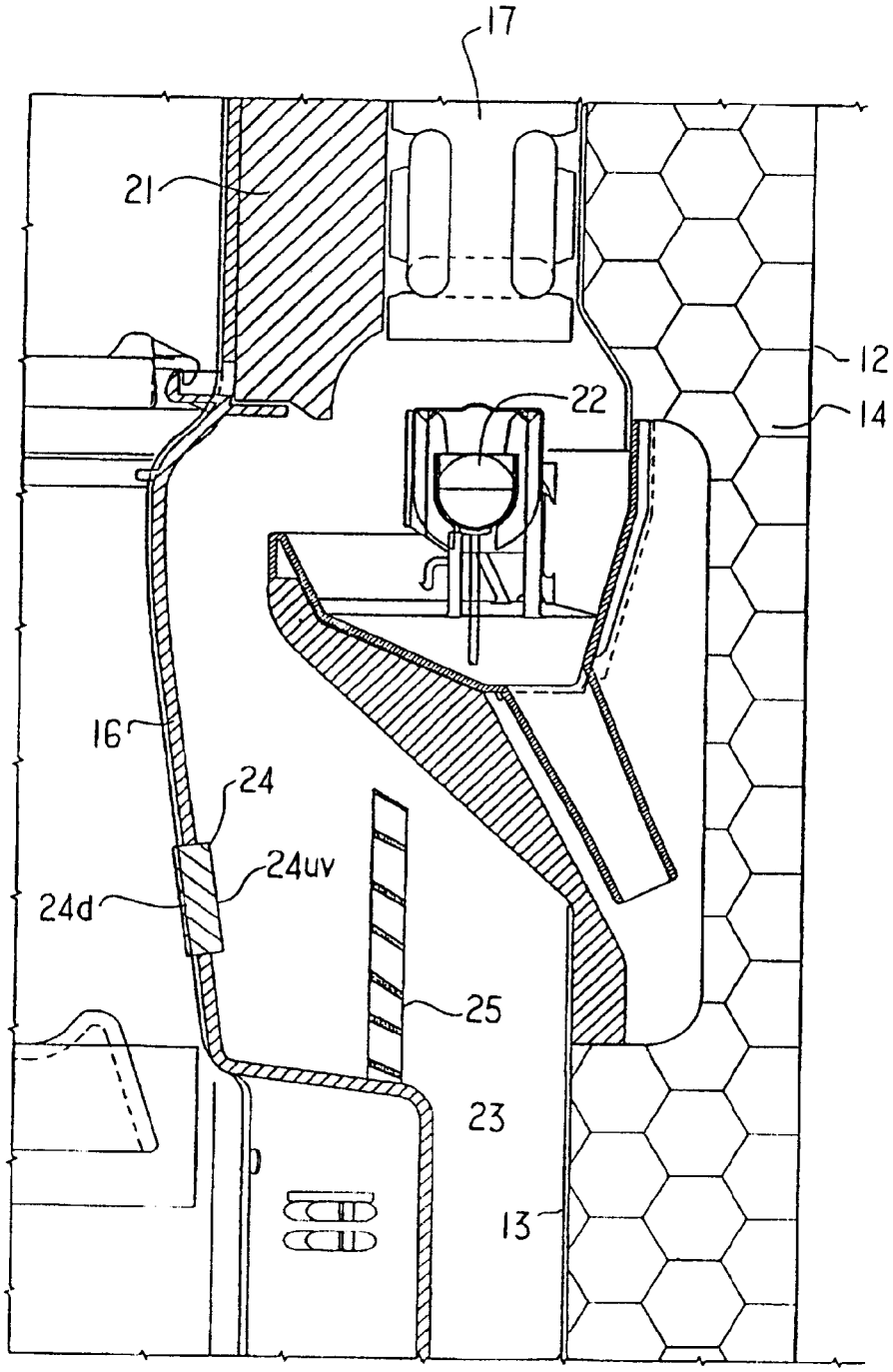
FIG. 4 shows an enlarged view of one portion in FIG. 2.
Figure 5:
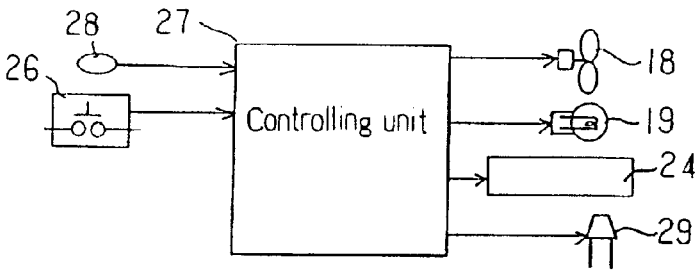
FIG. 5 shows a block diagram of a controlling circuit for the refrigerator of the invention.

FIG. 1 shows a front view of a refrigerator according to the embodiment of the invention. FIG. 2 shows a portion of the cross-sectional view of the refrigerator. FIG. 3 shows a back panel of the internal room of the refrigerator. FIG. 4 shows an enlarged view of one portion in FIG. 2. FIG. 5 shows a block diagram of a controlling circuit for the refrigerator of the invention.

FIGS. 1 and 2 shows a home refrigerator 10 having refrigerator compartments and a freezer compartment. From the top of the refrigerator 10, a cold storage compartment (cold temperature zone), a vegetable storage compartment (cold temperature zone) and a freezer compartment (freeze temperature zone) are arranged in sequence.

As shown in FIG. 2, the refrigerator 10 is a two-evaporator type, and has a cooler 17 for the cold storage compartment (cold temperature zone) and a cooler for the freezer compartment (freeze temperature zone). The refrigerator 10 consists of an exterior housing 12 and an interior housing 13. Foam 14 is filled between the exterior housing 12 and the interior housing 13. A rotatable door 15 is mounted to the cold storage compartment. The item 16 is a back panel of the interior housing 13. An air duct is arranged behind the back panel 16 and between the exterior housing 12 and the interior housing 13. A cooler 17 is installed for cooling the cold storage compartment.

The fan 18 is used for circulating the cold air in the refrigerator and also used for creating an air curtain. By driving the fan 18, the air curtain is created in front of the the cold storage compartment. In the cold storage compartment, an interior lamp is also arranged. The cold air from the cooler 17 flows to the upper part of the refrigerator path through a cold air passage 20 due to the fan 18.

Item 21 is a thermal insulation material, and item 22 is a heater for defrosting. The cold air from the cold storage compartment and the vegetable storage compartment flows back to the cooler 17 through the air duct 23.

The ultraviolet discharging lamp 24 is used for irradiating ultraviolet rays with a wavelength of 254 nm, and is a plane shape in the embodiment. The ultraviolet rays irradiate the inside of the air duct 23. A reflection material, such as aluminum, is adhered to the surface of the air duct where the ultraviolet rays can reach to keep the resin from deformation.

FIG. 3 shows the back panel 13 and the ultraviolet discharging lamp 24. The ultraviolet discharging lamp 24 is usually made of glass or soda glass. Therefore, due to its characteristic for passing a particular wavelength, harmful ultraviolet rays do not irradiate to the cold storage compartment, which means that the harmful ultraviolet rays with a wavelength below 300 nm are blocked.

Shown in FIG. 2 is a light catalyst filter 25. The light catalyst is deposed on an adsorber to serve as the surface layer of the light catalyst filter 25. The adsorber 25 can be a zeolite with a small water absorbing rate. For example, the weight increasing rate is below 5% in an environment of 100% humidity. If the water absorbing rate is too high, the absorbed water makes the adsorption for the odor molecules become worse. The light catalyst filter 25 is a corrugated cardboard type. In addition, the light catalyst filter 25 can be a honey comb type.

The filter 25 can be arranged at the bent portion of the air duct 23 so that the tilt direction of the air holes of the filter 25 is consistent with the passing direction A of the cold air. Namely, the tilt direction of the air holes of the filter 25 is substantially the same as the tilt direction of the air duct 23, or the tilt direction of the air holes of the filter 25 is consistent with the air flow in the air duct. In this way, the cold air flow at least does not become worse. In addition, the reflection material, such as aluminum, adhered on the air duct 23 will reflect the ultraviolet rays, and the ultraviolet rays return to the opposite side of the filter 25, so that the deodorization effect can be further increased.

In FIG. 1, the setting switch 28 is used for setting and disabling the antimicrobial mode. The light emitting element (lighting display device) 29 is used for indicating whether the ultraviolet discharging lamp 24 is lit or not.

Next, the deodorization and the antimicrobial functions are described in detail. After the fan 18 of the refrigerator is activated, the cold air in the refrigerator begins its circulation, and the odor molecules in the cold air begin to flow. The odor molecules are then accumulated and adsorbed on the adsorber of the filter 25. The odor molecules are then decomposed by the light catalyst that is activated by the ultraviolet rays irradiated from the ultraviolet discharging lamp 24. By the ultraviolet rays with a wavelength of 254 nm irradiated by the ultraviolet discharging lamp 24, the odor molecules accumulated and adsorbed on the adsorber of the filter 25 are decomposed by the light catalyst activated by the ultraviolet rays.

In addition, because the ultraviolet rays with a wavelength of 254 nm also have an antimicrobial function, the floating bacteria in the air duct 23 and the bacteria accumulated by the adsorber of the filter 25 will also be killed by the ultraviolet rays. Then, the carcass of the bacteria that accumulated on the adsorber of the filter 25 and then were killed by the ultraviolet rays are decomposed by the light catalyst.

A more detailed description is made with reference to FIG. 4. In FIG. 4, the ultraviolet discharging lamp 24 irradiates ultraviolet rays with a wavelength of 254 nm. The irradiating surface 24*uv* of the ultraviolet discharging lamp 24 is made of quartz glass that the ultraviolet rays with a wavelength of 185 nm can pass through. The ultraviolet discharging lamp 24 is arranged at windward position of the light catalyst filter 25.

As described above, the ultraviolet discharging lamp 24 irradiates the ultraviolet rays with a wavelength of 254 nm to the air duct for killing bacteria. The bacteria adsorbed on the surface of the filter 25 are continuously irradiated by the ultraviolet rays with the wavelength of 254 nm. Accordingly, the bacteria are killed and eliminated. The carcass of eliminated bacteria is decomposed by the light catalyst activated by the ultraviolet rays.

After the fan 18 is activated, cold air begins to circulate and the odor molecules in the air duct are accumulated by the adsorber of the filter 25. The odor molecules are then decomposed by the light catalyst.

A controlling method for the deodorization and the antimicrobial mode of the refrigerator is described with reference to FIG. 5. As shown in FIG. 5, a detecting device 26 is used for detecting the status of the door 15 of the cold storage compartment. A controlling unit 27 is constituted of a single-chip micro processor. A setting switch 28 is used for setting and disabling the antimicrobial mode. Numeral 19 is the interior lamp.

The operation of the setting switch 28 is first described to discuss the setting and disabling of the antimicrobial mode. When the door 15 of the cold storage compartment is opened, the controlling device 27 can detect that the door 15 is opened according to a signal from the detecting device 26. Next, the controlling device 27 drives the fan 18 and lights the ultraviolet discharging lamp 24 and the interior lamp 19. Then, the light emitting element 29 is also lit. By driving the fan 18, an air curtain is created in front of the cold storage compartment to suppress the exterior air from flowing into the refrigerator.

By lighting the ultraviolet discharging lamp 24, the ultraviolet rays are directly irradiated into the air duct 23 to directly kill bacteria by the ultraviolet rays and to decompose the odor molecules by the light catalyst. In addition, the ultraviolet discharging lamp 24 can also irradiate a visible light to the inside of the refrigerator to kill bacteria.

After the door 15 is closed, the controlling device 27 can be acknowledged according to a signal from the detecting device 26. The controlling device 27 turns off the interior lamp 19. In addition, the controlling device 27 will keep driving the fan 18 and lighting the ultraviolet discharging lamp 24 continuously for 5 minutes, and then stops the fan 18 and turns off the ultraviolet discharging lamp 24. Although the fan 18 is driven and the ultraviolet discharging lamp 24 is lit continuously for 5 minutes, the operation time interval is not a limitation to the invention.

Driving the fan 18 to operate continuously for 5 minutes more is used for reducing the temperature unevenness caused by the external air that flows into the refrigerator when opening the door 15. Furthermore, driving the ultraviolet discharging lamp 24 to keep lit continuously for 5 minutes more is used for eliminating the bacteria that enter the refrigerator when opening the door 15.

In this antimicrobial mode, when the door 15 is opened or at the instant of opening the door 15, the antimicrobial and the deodorization operations begin to be performed at the same time, so the bacteria can be eliminated more efficiently. However, if the antimicrobial and the deodorization operations begin to perform only at the above time point when the door 15 is opened or at the instant of opening the door 15, the antimicrobial and the deodorization operations cannot be performed when the door 15 is not opened.

Therefore, in the embodiment, when the door 15 of the cold storage compartment is continuously closed for over 4 hours, the controlling device 27 then lights the ultraviolet discharging lamp 24 for about 4 minutes. In this way, even though the door 15 is not opened, the antimicrobial and the deodorization operations can still be operated.

Additionally, during an interval that the door 15 is continuously closed, and the cooler 17 is operated to defrost in the refrigerator, lighting the ultraviolet discharging lamp 24 will be delayed. The reason is to avoid unnecessary temperature rising in the cold storage compartment because of the heat generated by lighting the ultraviolet discharging lamp 24. In other words, even though the door 15 is continuously closed for over 4 hours, if the cooler 17 is operated to defrost, lighting the ultraviolet discharging lamp 24 will be delayed. After defrosting, the ultraviolet discharging lamp 24 is then lit.

In the embodiment, the ultraviolet discharging lamp 24 is lit after the door 15 is continuously closed for 4 hours, but it is not used for limiting the scope of the invention. For example, the ultraviolet discharging lamp 24 can always be lit. In addition, although the ultraviolet discharging lamp 24 is lit for 4 minutes, this is not used for limiting the scope of the invention.

Next, the following description discusses a situation when the door 15 is opened. Opening the door 15 for a long time will reduce the effect of the air curtain. Therefore, when the door 15 is continuously opened for over 1 minute (the second preset time), the controlling device 27 stops driving the fan 18 from forming the air curtain. In addition, when the door 15 is continuously opened for over 1 minute (the third preset time), the controlling device 27 stops lighting the ultraviolet discharging lamp 24.

In other words, when the door 15 is continuously opened for over 1 minute, the fan 18 is stopped and the ultraviolet discharging lamp 24 is turned off. In the embodiment, the second and the third preset times are 1 minute, but it is not used for limiting the scope of the invention. The second and the third preset times can be different.

Afterwards, when the door 15 is closed, the aforementioned operations are executed. In other words, the controlling device 27 knows that the door 15 is closed according to a signal from the detecting device 26. Then, the controlling device 27 turns off the interior lamp 19. Furthermore, the controlling device 27 continuously drives the fan 18 to operate and lights the ultraviolet discharging lamp 24. After 5 minutes, the controlling device 27 stops driving the fan 18 and lighting the ultraviolet discharging lamp 24.

Next, the following description discusses the operation of the setting switch 28 to set and disable the antimicrobial mode of the refrigerator. When the door 15 is opened, the controlling device 27 knows that the door 15 is opened according to a signal from the detecting device 26, and then drives the fan and lights the ultraviolet discharging lamp 24. By driving the fan 18, the air curtain is created in front of the cold storage compartment to suppress the external air from entering the refrigerator.

As described above, because the ultraviolet discharging lamp 24 is not turned on, no antimicrobial operation is performed. Afterwards, when the door 15 is closed, the controlling device 27 can know that the door 15 is closed according to a signal from the detecting device 26, and then turns off the interior lamp 19. After 5 minutes, the controlling device 27 stops driving the fan 18. Because the antimicrobial and the deodorization operations are performed by the ultraviolet discharging lamp 24, if the ultraviolet discharging lamp 24 is not lit, the deodorization operation is not executed.

In the embodiment, the controlling device 27 lights the ultraviolet discharging lamp 24 for 4 minutes every 4 hours to deodorize the refrigerator. If the door 15 of the cold storage compartment is opened when the ultraviolet discharging lamp 24 is lit, the detecting device 26 will detect that the door 15 is opened and then the controlling device 27 turns off the ultraviolet discharging lamp 24. Because the ultraviolet discharging lamp 24 is lit as the door 15 is opened, the user does not have to disable the antimicrobial mode, so that the malfunction and the mistake can be avoided.

As described above, according to the invention, when the door is opened and the bacteria enter the refrigerator, the antimicrobial efficiency becomes better because the ultraviolet discharging lamp is lit.

According to the invention, because the ultraviolet discharging lamp is lit after a preset time interval when the door is closed, the bacteria that enter the refrigerator when opening the door can be efficiently eliminated.

According to the invention, because a lighting display device is installed for displaying the status of the ultraviolet discharging lamp, the user can confirm the status of the ultraviolet discharging lamp even though the door is not opened.

According to the invention, because the ultraviolet discharging lamp can be always lit when disabling the antimicrobial mode, the deodorization operation can be still performed using the light catalyst filter when the antimicrobial mode is disabled.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A refrigerator, comprising:

an ultraviolet discharging lamp, for irradiating ultraviolet rays to an air duct inside the refrigerator, and irradiating a visible light to a cold storage compartment of the refrigerator;

a light catalyst filter, installed in the air duct and activated by the ultraviolet rays; and a controlling device for lighting the ultraviolet discharging lamp when a door of the cold storage compartment of the refrigerator is opened.

2. The refrigerator of claim 1, further comprising a lighting display device, arranged outside of the refrigerator, for displaying a status whether the ultraviolet discharging lamp is lit or not.

3. A refrigerator, comprising:

an ultraviolet discharging lamp, for irradiating ultraviolet rays to an air duct inside the refrigerator, and irradiating a visible light to a cold storage compartment of the refrigerator;

a light catalyst filter, installed in the air duct and activated by the ultraviolet rays;

a fan for forming an air curtain when a door of the cold storage compartment of the refrigerator is opened; and a controlling device for lighting the ultraviolet discharging lamp when the door of the cold storage compartment of the refrigerator is opened.

4. The refrigerator of claim 3, wherein the controlling device lights the ultraviolet discharging lamp after a preset interval from a time that the door is closed.

5. The refrigerator of claim 4, wherein the controlling device stops the fan forming the air curtain when the door is continuously opened for a second preset time interval.

6. The refrigerator of claim 4, wherein the controlling device turns off the ultraviolet discharging lamp when the door is continuously opened for a third preset time interval.

7. The refrigerator of claim 3, wherein the controlling device lights the ultraviolet discharging lamp when the door is closed for over a fourth preset time.

8. The refrigerator of claim 3, wherein the controlling device lights the ultraviolet discharging lamp when the door is closed for over a fourth preset time and a cooler of the refrigerator does not defrost.

9. The refrigerator of claim 3, further comprising an lighting display device, arranged outside of the refrigerator, for displaying a status whether the ultraviolet discharging lamp is lit or not.

10. A refrigerator, comprising:

an ultraviolet discharging lamp, for irradiating ultraviolet rays to an air duct inside the refrigerator, and irradiating a visible light to a cold storage compartment of the refrigerator;

a light catalyst filter, installed in the air duct and activated by the ultraviolet rays;

an operating device for setting or disabling an antimicrobial mode of the refrigerator; and a controlling device for lighting the ultraviolet discharging lamp for a preset interval, and turning off the ultraviolet discharging lamp when a door of the refrigerator is opened, when the antimicrobial mode is disabled.

11. The refrigerator of claim 10, further comprising a lighting display device, arranged outside of the refrigerator, for displaying a status whether the ultraviolet discharging lamp is lit or not.

12. A refrigerator, comprising:

an ultraviolet discharging lamp, for irradiating ultraviolet rays to an air duct inside the refrigerator, and irradiating a visible light to a cold storage compartment of the refrigerator;

a light catalyst filter, installed in the air duct and activated by the ultraviolet rays;

an operating device for setting or disabling an antimicrobial mode of the refrigerator; and a controlling device for keeping the ultraviolet discharging lamp lit, even when disabling the antimicrobial mode and in an interval other than when a cooler of the refrigerator defrosts.

13. The refrigerator of claim 12, further comprising a lighting display device, arranged outside of the refrigerator, for displaying a status whether the ultraviolet discharging lamp is lit or not.

14. A refrigerator, comprising:

an ultraviolet discharging lamp, for irradiating ultraviolet rays to an air duct inside the refrigerator, and irradiating a visible light to a cold storage compartment of the refrigerator;

a light catalyst filter, installed in the air duct and activated by the ultraviolet rays; and a controlling device for lighting the ultraviolet discharging lamp, when a door of the refrigerator is opened, wherein the controlling device lights the ultraviolet discharging lamp after a preset interval from a time that the door is closed.

15. A refrigerator, comprising:

an ultraviolet discharging lamp, for irradiating ultraviolet rays to an air duct inside the refrigerator, and irradiating a visible light to a cold storage compartment of the refrigerator;

a light catalyst filter, installed in the air duct and activated by the ultraviolet rays; and an lighting display device, arranged outside of the refrigerator, for displaying a status whether the ultraviolet discharging lamp is lit or not.

16. A refrigerator, comprising:

an ultraviolet discharging lamp, for irradiating ultraviolet rays;

a light catalyst filter, installed in the air duct and activated by the ultraviolet rays;

an operating device for setting or disabling an antimicrobial mode of the refrigerator; and a controlling device for keeping the ultraviolet discharging lamp lit, even when an antimicrobial mode of the refrigerator is disabled.

* * * * *